US009079731B2

(12) United States Patent
Takahata

(10) Patent No.: US 9,079,731 B2
(45) Date of Patent: Jul. 14, 2015

(54) SHEET SEPARATOR

(71) Applicant: Brother Kogyo Kabushiki Kaisha, Nagoya-shi, Aichi-ken (JP)

(72) Inventor: Muneaki Takahata, Toyoake (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/294,233

(22) Filed: Jun. 3, 2014

(65) Prior Publication Data

US 2014/0353905 A1 Dec. 4, 2014

(30) Foreign Application Priority Data

Jun. 3, 2013 (JP) ..... 2013-116773

(51) Int. Cl.
*B65H 3/52* (2006.01)
*B65H 3/06* (2006.01)
*B65H 1/08* (2006.01)

(52) U.S. Cl.
CPC ..... *B65H 3/0684* (2013.01); *B65H 1/08* (2013.01)

(58) Field of Classification Search
CPC ..... B65H 3/52; B65H 3/5223; B65H 3/5238; B65H 2405/1118; B65H 2405/114; B65H 2511/12; B65H 2701/1131; B65H 1/04
USPC ..... 271/121, 122, 171, 124, 145, 147
See application file for complete search history.

(56) References Cited

U.S. PATENT DOCUMENTS

| | | | | |
|---|---|---|---|---|
| 6,152,442 | A * | 11/2000 | Nishinohara et al. | 271/121 |
| 6,361,037 | B1 * | 3/2002 | Nakagawa | 271/10.11 |
| 7,703,763 | B2 * | 4/2010 | Shiohara et al. | 271/145 |
| 8,109,498 | B2 | 2/2012 | Akimatsu | |
| 2011/0074078 | A1 | 3/2011 | Nakano et al. | |
| 2011/0074087 | A1 | 3/2011 | Akimatsu | |

FOREIGN PATENT DOCUMENTS

| | | | |
|---|---|---|---|
| GB | 2235438 | * | 3/1991 |
| JP | 2-291324 | * | 12/1990 |
| JP | H05-69955 | A | 3/1993 |
| JP | H09-67026 | A | 3/1997 |
| JP | H11-180568 | A | 7/1999 |
| JP | 2000-272765 | A | 10/2000 |
| JP | 2011-073814 | A | 4/2011 |

* cited by examiner

*Primary Examiner* — Thomas Morrison
(74) *Attorney, Agent, or Firm* — Banner & Witcoff, Ltd.

(57) ABSTRACT

A sheet separator including two guides disposed to face each other across a distance in a width direction, at least one of the two guides being configured to move along the width direction to enlarge or reduce the distance therebetween, a separation roller, a separation pad configured to separate sheets being conveyed by the separation roller on a sheet-by-sheet basis in cooperation with the separation roller, a pressing mechanism configured to apply a pressing load to press the separation pad toward the separation roller, and an adjuster configured to increase the pressing load in response to the at least one of the two guides moving in a direction to enlarge the distance, and decrease the pressing load in response to the at least one of the two guides moving in a direction to reduce the distance.

12 Claims, 9 Drawing Sheets

SHEET SEPARATOR

CROSS-REFERENCE TO RELATED APPLICATION

This application claims priority under 35 U.S.C. §119 from Japanese Patent Application No. 2013-116773 filed on Jun. 3, 2013. The entire subject matter of the application is incorporated herein by reference.

BACKGROUND

1. Technical Field

The following description relates to one or more techniques for a sheet separator.

2. Related Art

A sheet separator has been known that includes a supporting section, two guides, a separation roller, a separation pad, a holder, and a pressing mechanism.

The supporting section is configured to support a plurality of sheets. The two guides are provided at the supporting section. The two guides are disposed to face each other across a distance in a width direction of the sheets supported by the supporting section. The two guides are configured to move along the width direction so as to enlarge or reduce the distance therebetween in the width direction, and to position the sheets supported by the supporting section in the width direction. The separation roller is configured to rotate around a first axis parallel to the width direction, and to feed (convey) the sheets supported by the supporting section in a conveyance direction. The separation pad is configured to separate sheets being fed by the separation roller on a sheet-by-sheet basis in cooperation with the separation roller. The holder is configured to hold the separation pad in a manner capable of being closer to or farther from the separation roller. The pressing mechanism includes a single compressive coil spring, and is configured to apply a pressing load to press the separation pad toward the separation roller.

In the known sheet separator, when the pressing mechanism applies the pressing load to press the separation pad held by the holder toward the separation roller, a braking force generated between the separation roller and the separation pad is applied to the sheets. Consequently, in the known sheet separator, when the separation roller is about to concurrently feed a plurality of sheets, the braking force is applied to sheets, of those sheets, other than a sheet in contact with the separation roller, so as to separate the sheets on a sheet-by-sheet basis.

SUMMARY

In the meantime, in the known sheet separator, the pressing mechanism is configured to apply a constant pressing load to press the separation pad toward the separation roller, regardless of the width of the sheets. Therefore, in the known sheet separator, there might be caused various problems. Suppose, for instance, that the pressing load is set on the basis of a large width of sheets. Actually, a pressing load required for separating smaller-width sheets is lower than a pressing load required for separating larger-width sheets. Therefore, when the pressing load is set on the basis of the larger-width sheets, it might cause an undesired situation where a higher pressing load is always applied between the separation roller and the separation pad, and the separation roller and the separation pad become worn more quickly. Meanwhile, when the pressing load is set on the basis of the smaller-width sheets, a too small braking force is applied to the larger-width sheets. In this case, multi feed is more likely to occur due to an undesired situation where sheets other than a sheet in contact with the separation roller slip relative to the separation pad when the separation roller is about to concurrently feed (convey) a plurality of sheets.

Aspects of the present disclosure are advantageous to provide one or more improved techniques, for a sheet separator, which make it possible to feed (convey) sheets in a manner successfully separated on a sheet-by-sheet basis regardless of the width of the sheets, and to prevent components such as a separation roller and a separation pad from being worn.

According to aspects of the present disclosure, a sheet separator is provided, which includes a supporter configured to support one or more sheets, two guides provided to the supporter, the two guides being disposed to face each other across a distance in a width direction of the one or more sheets supported by the supporter, at least one of the two guides being configured to move along the width direction to enlarge or reduce the distance between the two guides in the width direction, and position the one or more sheets supported by the supporter in the width direction, a separation roller configured to rotate around a first axis parallel to the width direction, and convey the one or more sheets supported by the supporter in a conveyance direction, a separation pad configured to separate sheets being conveyed by the separation roller, on a sheet-by-sheet basis in cooperation with the separation roller, a holder configured to hold the separation pad in a manner capable of being closer to or farther from the separation roller, a pressing mechanism configured to apply a pressing load to press the separation pad toward the separation roller, and an adjuster configured to increase the pressing load in response to the at least one of the two guides moving in a direction to enlarge the distance between the two guides, and decrease the pressing load in response to the at least one of the two guides moving in a direction to reduce the distance between the two guides.

According to aspects of the present disclosure, further provided is a sheet separator including a supporter configured to support one or more sheets, two guides disposed to face each other across a distance in a width direction of the one or more sheets supported by the supporter, at least one of the two guides being configured to move along the width direction to enlarge or reduce the distance between the two guides in the width direction, and position the one or more sheets supported by the supporter in the width direction, a separation roller configured to rotate and convey the one or more sheets supported by the supporter in a conveyance direction, a separation pad configured to be urged toward the separation roller under a pressing load, and separate sheets being conveyed by the separation roller, on a sheet-by-sheet basis in cooperation with the separation roller, a load adjusting mechanism configured to adjust the pressing load depending on a length in the width direction of the one or more sheets to be conveyed by the separation roller, by increasing the pressing load in response to the at least one of the two guides moving in a direction to enlarge the distance between the two guides, and decreasing the pressing load in response to the at least one of the two guides moving in a direction to reduce the distance between the two guides.

BRIEF DESCRIPTION OF THE ACCOMPANYING DRAWINGS

DETAILED DESCRIPTION

It is noted that various connections are set forth between elements in the following description. It is noted that these connections in general and, unless specified otherwise, may be direct or indirect and that this specification is not intended to be limiting in this respect.

Hereinafter, illustrative embodiments according to aspects of the present disclosure will be described with reference to the accompanying drawings.

(First Illustrative Embodiment)

Figure 1:
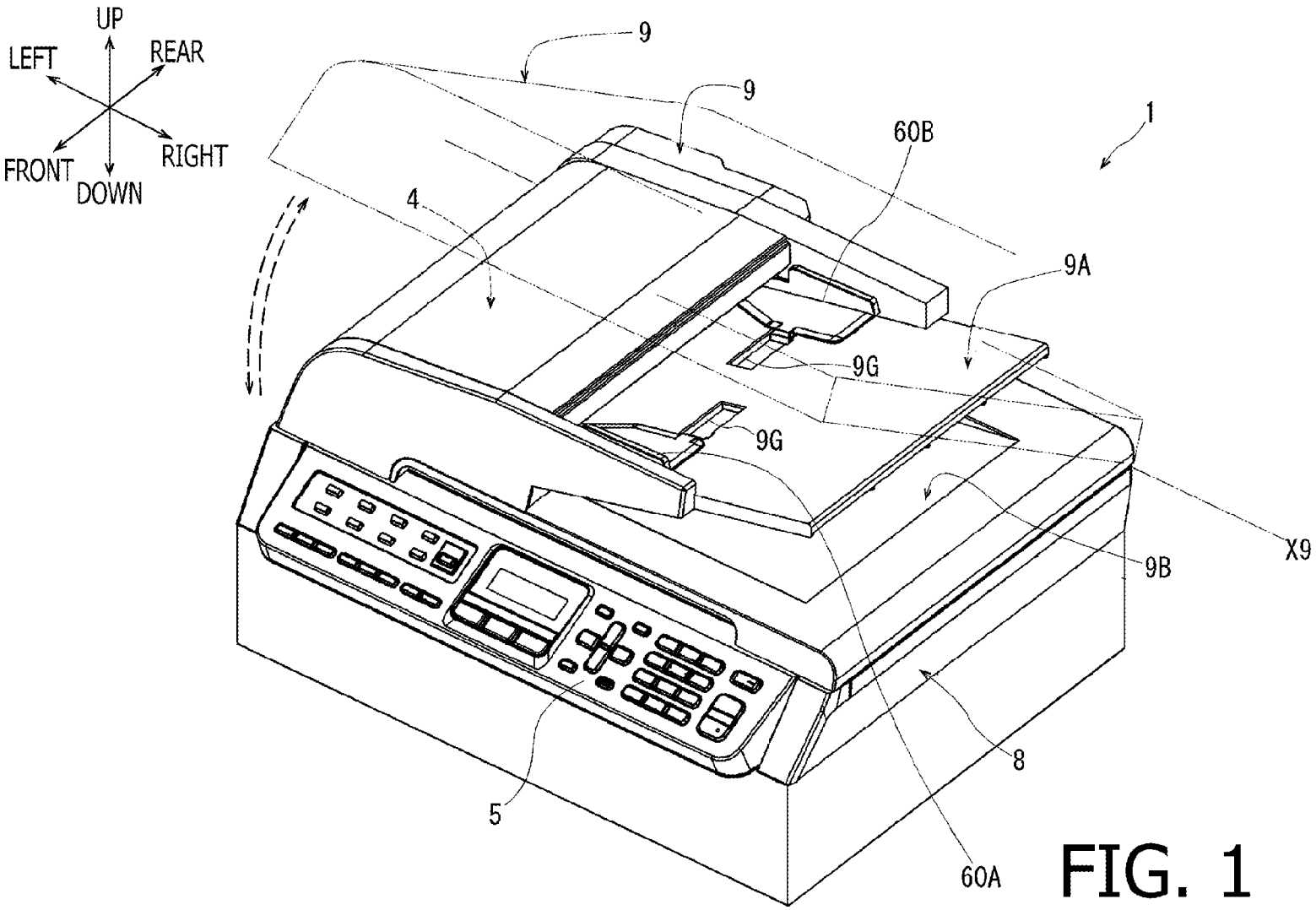
FIG. 1 is a perspective view of an image reader in a first illustrative embodiment according to one or more aspects of the present disclosure.

FIG. 1 shows an image reader 1 in a first illustrative embodiment. In the following descriptions, as shown in FIG. 1, a side at which an operation panel 5 is provided is defined as a front side of the image reader 1. In a front view of the image reader 1 (when viewed toward the operation panel 5), a left-hand side is defined as a left side of the image reader 1. Thus, a front-to-rear direction, a left-to-right direction, and a vertical direction are defined. Hereinafter, referring to FIG. 1, each of elements included in the printer 1 will be described.

<Overall Configuration>

As shown in FIG. 1, the image reader 1 includes a main body section 8 and an opening-closing section 9. The main body section 8 is formed substantially in a flattened box shape. The operation panel 5 is disposed at a front portion of the main body section 8.

Figure 2:
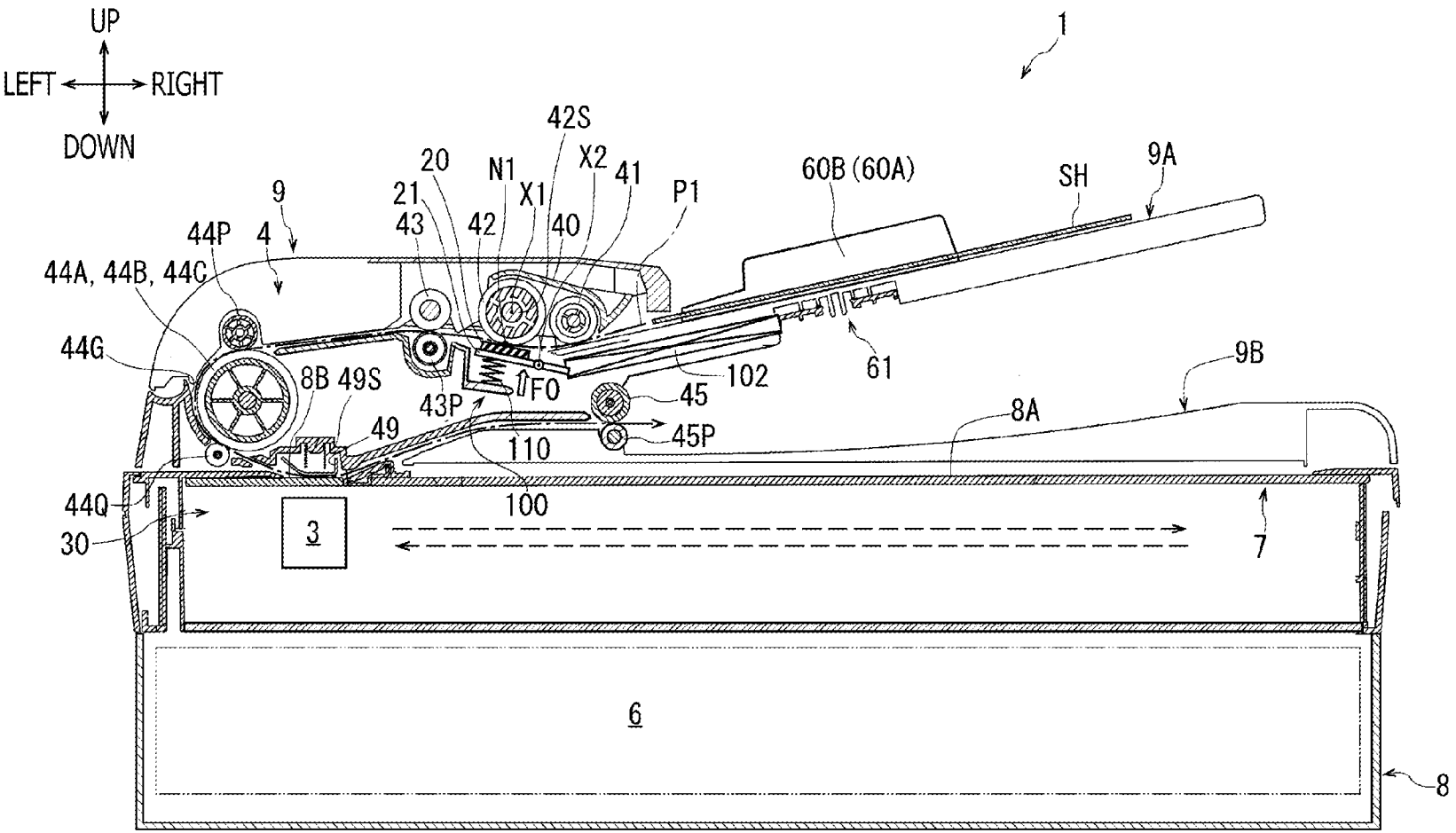
FIG. 2 is a cross-sectional side view schematically showing the image reader in the first illustrative embodiment according to one or more aspects of the present disclosure.

As shown in FIG. 2, there is an image forming unit 6 disposed at a lower portion of the main body section 8. The image forming unit 6 contains therein an image forming section (not shown) configured to perform image formation in an inkjet method or a laser method.

A reading unit 30 is disposed at an upper portion of the main body section 8. On an upper surface of the reading unit 30, a platen glass 7 is disposed. An upper surface of the platen glass 7 may be referred to as a supporting surface 8A. The supporting surface 8A is configured to support a sheet (e.g., a paper, a transparency, and a book) to be read that is statically placed on the platen glass 7.

As shown in FIG. 1, the opening-closing section 9 is supported by the main body section 8 via a hinge (not shown) disposed at an upper end portion of a rear side of the main body section 8, in a manner swingable around an opening-closing axis X9 extending in the left-to-right direction. As indicated by a solid line in FIG. 1, when closed, the opening-closing section 9 covers the supporting surface 8A from above. Meanwhile, as indicated by a long dashed double-short dashed line in FIG. 1, an upper side of the supporting surface 8A is opened, when the opening-closing section 9 is swung around the opening-closing axis X9 with a front side of the opening-closing section 9 being moved toward an upper rear side. Thereby, a user is allowed to cause the supporting surface 8A to support a sheet to be read.

Further, as shown in FIGS. 1 and 2, the image reader 1 includes a reading section 3, a feed tray 9A, an ejection section 9B, two guides 60A and 60B, a feeding section 4, and a pressing mechanism 100.

As shown in FIG. 2, the reading section 3 is accommodated in the reading unit 30. For instance, the reading section 3 may include one of known image reading sensors such as a contact image sensor (CIS) and a charge coupled device (CCD). The reading section 3 is configured to reciprocate along the left-to-right direction under the platen glass 7, by a scanning mechanism (not shown).

When reading a sheet supported by the supporting surface 8A, the image reader 1 causes the scanning mechanism (not shown) to move the reading section 3 from a left end portion to a right end portion inside the reading unit 30. Further, when reading images while feeding a plurality of sheets SH on the feed tray 9A, the image reader 1 causes the scanning mechanism (not shown) to stop the reading section 3 in a position at the left end portion inside the reading unit 30 (see FIG. 2). Hereinafter, the position of the reading section 3 shown in FIG. 2 may be referred to as a reading position. A (partial) surface of the platen glass 7 that is located above the reading section 3 staying in the reading position may be referred to as a reading surface 8B.

As shown in FIGS. 1 and 2, the feed tray 9A is disposed at an upper right portion of the opening-closing section 9. The ejection section 9B is provided at a right side of the opening-closing section 9, under the feed tray 9A. The feeding section 4 is disposed at a left side of the opening-closing section 9. The feed tray 9A is configured to support a plurality of sheets SH to be fed by the feeding section 4, from beneath. The ejection section 9B is configured to receive and support a sheet SH ejected after the sheet SH has been fed by the feeding section 4, and an image on the sheet SH has been read by the reading section 3 staying in the reading position.

As shown in FIGS. 1 and 2, the two guides 60A and 60 are provided at the feed tray 9A. The two guides 60A and 60B are disposed to face each other across a distance in the front-to-rear direction (a sheet width direction).

As shown in FIG. 1, there are guide rails 9G formed on the feed tray 9A. Each guide rail 9G extends in the front-to-rear direction. The two guides 60A and 60B are supported by the feed tray 9A to be slidable along the guide rails 9G in the front-to-rear direction, respectively. As shown in FIG. 2, the two guides 60A and 60B are joined via a rack-and-pinion mechanism 61 disposed on a back side (a downward-facing side) of the feed tray 9A.

Figure 3:
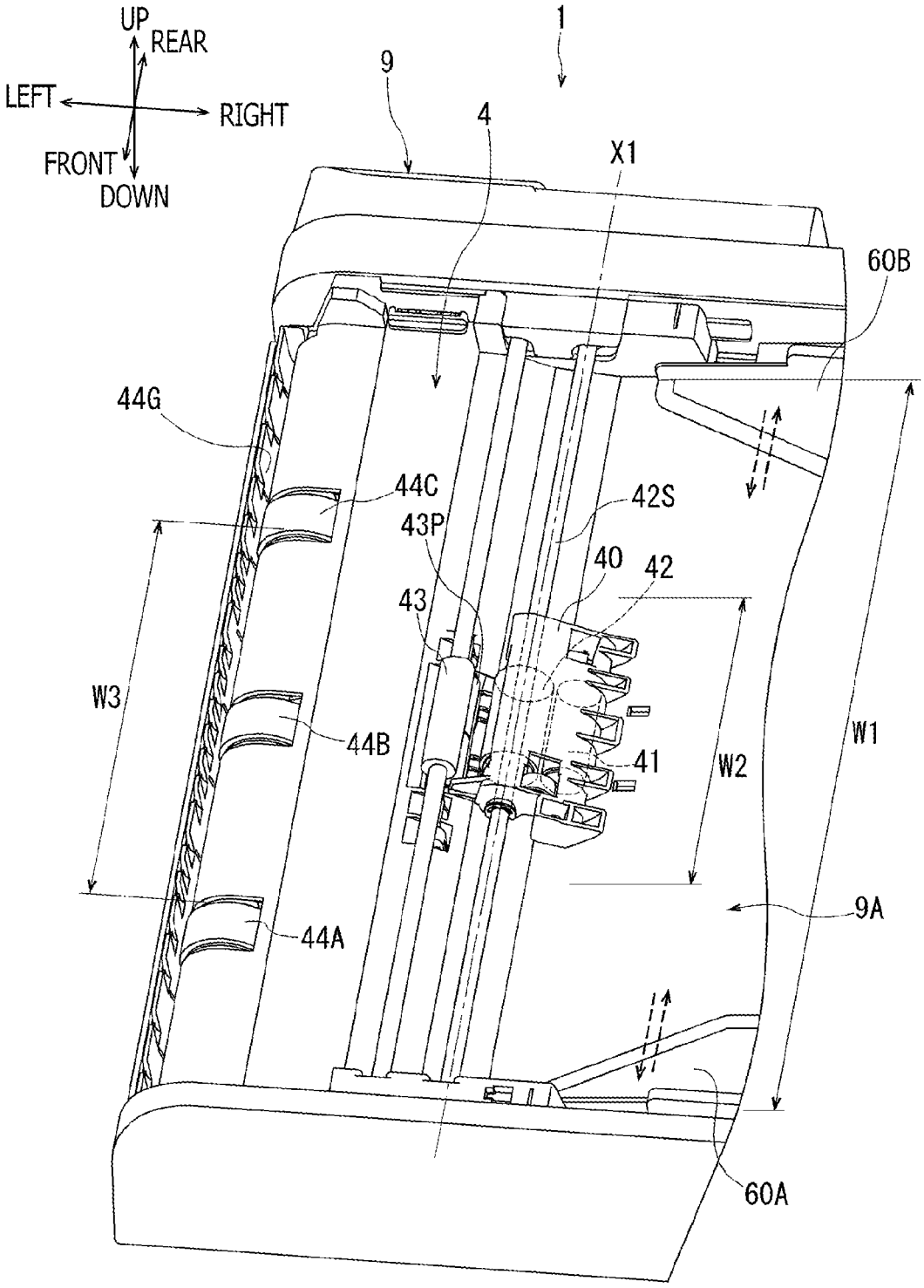
FIG. 3 is a perspective view showing elements included in the image reader such as a feed tray, two guides, a separation roller, and a plurality of feed rollers in the first illustrative embodiment according to one or more aspects of the present disclosure.
Figure 4A:
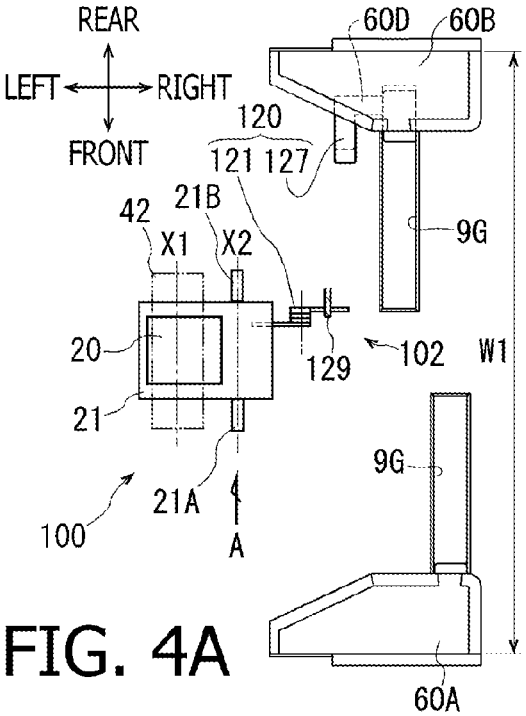
FIG. 4A is a top view showing a pressing mechanism in a state where a second urging force applied by a second pressing portion is decreased in response to the two guides moving in such directions as to enlarge a distance between the two guides in the first illustrative embodiment according to one or more aspects of the present disclosure.
Figure 4B:
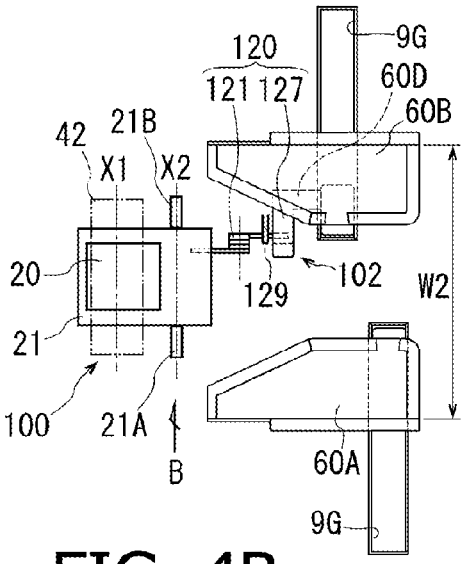
FIG. 4B is a top view showing the pressing mechanism in a state where the second urging force applied by the second pressing portion is increased in response to the two guides moving in such directions as to reduce the distance between the two guides in the first illustrative embodiment according to one or more aspects of the present disclosure.

As shown in FIGS. 3, 4A, and 4B, the rack-and-pinion mechanism 61 is configured to, when one of the two guides 60A and 60B is displaced in the front-to-rear direction to become closer to the other guide 60A or 60B, transmit the displacement to the other guide 60A or 60B and displace the other guide 60A or 60B to become closer to the one guide 60A or 60B. Further, the rack-and-pinion mechanism 61 is configured to, when the one guide 60A or 60B is displaced in the front-to-rear direction to become farther from the other guide 60A or 60B, transmit the displacement to the other guide 60A or 60B and displace the other guide 60A or 60B to become farther from the one guide 60A or 60B. At this time, a distance between the guide 60A and a central portion of the feed tray 9A in the front-to-rear direction is always equal to a distance between the guide 60B and the central portion of the feed tray 9A in the front-to-rear direction.

Thus, when the two guides 60A and 60B move in the front-to-rear direction to enlarge or reduce the distance therebetween in the front-to-rear direction, the two guides 60A and 60B position the sheet SH supported by the feed tray 9A in the front-to-rear direction with reference to the central portion of the feed tray 9A in the front-to-rear direction.

When positioning a sheet SH with a relatively large width such as an A4-size sheet, the two guides 60A and 60B are spaced a distance W1 apart from each other (see FIG. 3). Meanwhile, when positioning a sheet SH with a relatively small width such as a postcard-size sheet, the two guides 60A and 60B are spaced a distance W2 apart from each other (see FIG. 3).

As shown in FIG. 2, the feeding section 4 is configured to, when the opening-closing section 9 is closed, sequentially feed the sheets SH on the feed tray 9A along a conveyance path P1. A conveyance direction in which the sheet SH is fed (conveyed) by the feeding section 4 varies along the conveyance path P1. The conveyance direction is a direction from right to left in a substantially first-half part of the conveyance path P1. Meanwhile, the conveyance direction is a direction from left to right in a substantially second-half part of the conveyance path P1.

More specifically, the conveyance path P1, which includes a horizontally-extending portion that substantially horizontally extends leftward from the feed tray 9A, is a space formed such that the sheets SH fed by the feeding section 4 pass therethrough. The feeding section 4 includes a feed roller 41, a separation roller 42, a separation pad 20, and a holder 21 disposed in respective positions along the horizontally-extending portion of the conveyance path P1. In other words, the feed roller 41, the separation roller 42, the separation pad 20, and the holder 21 form the horizontally-extending portion of the conveyance path P1.

As shown in FIGS. 2 and 3, the separation roller 42 is fixedly attached to a rotational shaft 42S. When the rotational shaft 42S is driven to rotate by a driving source (not shown), the separation roller 42 rotates around a first axis X1 parallel to the front-to-rear direction. The rotational shaft 42S of the separation roller 42 is inserted through a roller holder 40. The roller holder 40 is formed to cover the separation roller 42 from above and protrude further rightward relative to a right end portion of the separation roller 42. The feed roller 41 is disposed upstream relative to the separation roller 42 in the conveyance direction. The feed roller 41 is supported by the roller holder 40 to be rotatable around an axis parallel to the first axis X1. The roller holder 40 includes transmission gears (not shown). When the transmission gears transmit a rotational driving force from the rotational shaft 42S to the feed roller 41, the feed roller 41 rotates in synchronization with the separation roller 42. Then, the feed roller 41 feeds a sheet SH on the feed tray 9A toward a downstream side in the conveyance direction. The separation roller 42 feeds (conveys) the sheet SH placed on the feed tray 9A in the conveyance direction in cooperation with the feed roller 41.

As shown in FIGS. 4A to 6, the separation pad 20 is a small piece of friction material formed substantially is a rectangular shape. The separation pad 20 is held by the holder 21 in a manner capable of being closer to or farther from the separation roller 42.

More specifically, the holder 21 is formed substantially in a rectangular plate shape. As shown in FIGS. 4A and 4B, to an upper face of a left portion of the holder 21, the separation pad 20 is attached. The holder 21 includes two shaft portions 21A and 21B (a front shaft portion 21A and a rear shaft portion 21B) formed to protrude forward and rearward from a right portion of the holder 21, respectively.

As the two shaft portions 21A and 21B are supported by an inner frame of the opening-closing section 9, the holder 21 is swingable around a second axis X2. The second axis X2 is parallel to the first axis X1, and is located upstream in the conveyance direction relative to a contact point N1 between the separation roller 42 and the separation pad 20, i.e., located on a right side of the contact point N1.

Figure 5:
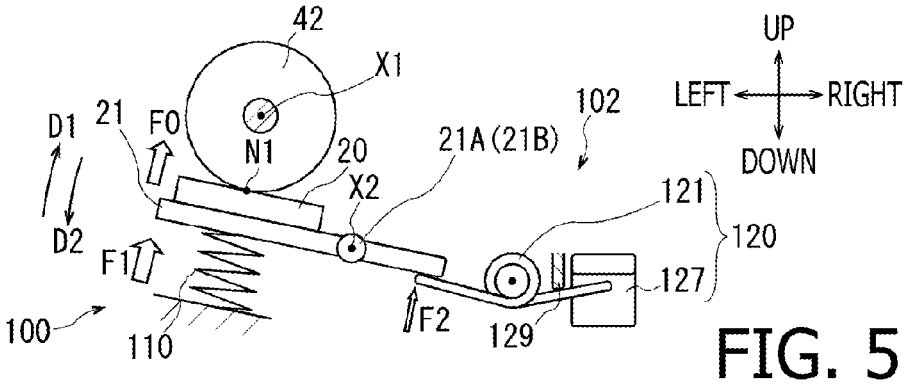
FIG. 5 is a front view of the pressing mechanism when viewed in a direction of an arrow A shown in FIG. 4A in the first illustrative embodiment according to one or more aspects of the present disclosure.
Figure 6:
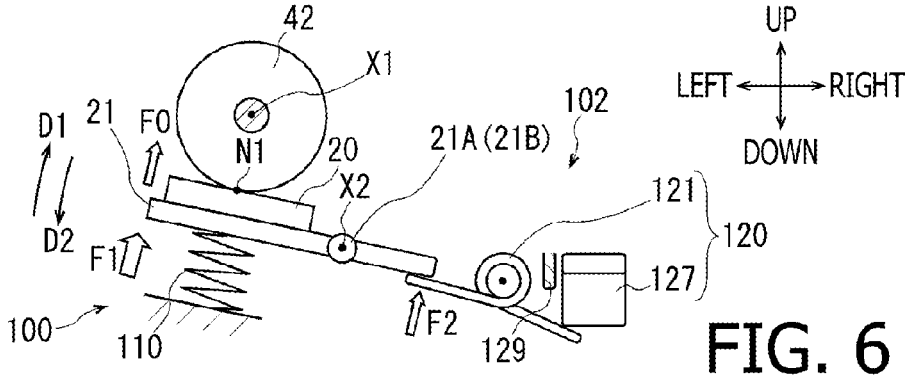
FIG. 6 is a front view of the pressing mechanism when viewed in a direction of an arrow B shown in FIG. 4B in the first illustrative embodiment according to one or more aspects of the present disclosure.

As shown in FIGS. 5 and 6, when swinging in a first swing direction D1 around the second axis X2 integrally with the holder 21, the separation pad 20 becomes closer to the separation roller 42. Meanwhile, when swinging in a second swing direction D2 (opposite to the first swing direction D1) around the second axis X2 integrally with the holder 21, the separation pad 20 becomes farther from the separation roller 42.

The pressing mechanism 100 is configure to apply a pressing load F0 to press the holder 21 (the separation pad 20) toward the separation roller 42. As will be described in detail below, the pressing load F0 is changed (increased or decreased) by an adjuster 102 disposed between the pressing mechanism 100 and the two guides 60A and 60B, in conjunction with movement of the two guides 60A and 60B.

When a plurality of sheets SH are fed by the feed roller 41 in a mutually-overlapping manner, the separation pad 20 separates the plurality of sheets SH on a sheet-by-sheet basis in cooperation with the separation roller 42. More specifically, as the pressing mechanism 100 applies the pressing load F0 to press the separation pad 20 held by the holder 21 toward the separation roller 42, a braking force generated between the separation roller 42 and the separation pad 20 is applied to the plurality of sheets SH. Thereby, when the plurality of sheets SH are about to be fed by the separation roller 42 in a mutually-overlapping manner, the braking force is applied to sheets other than a sheet in contact with the separation roller 42, of the plurality of sheets SH. Thus, the plurality of sheets SH are separated sheet by sheet.

Subsequently, as shown in FIG. 2, the conveyance path P1 includes a leftward-extending portion that further extends leftward following the horizontally-extending portion, and subsequently a U-turn portion that U-turns downward near a left surface of the opening-closing section 9 and then extends inclined downward toward the reading surface 8B of the platen glass 7. The feeding section 4 includes a first feed roller 43 and a pinch roller 43P disposed in respective positions along the leftward-extending portion of the conveyance path P1. The first feed roller 43 and the pinch roller 43P are disposed to face each other. The first feed roller 43 and the pinch roller 43P are configured to convey, toward second feed rollers 44, the sheets SH separated sheet by sheet by the separation roller 42 and the separation pad 20.

The feeding section 4 includes three second feed rollers 44A, 44B, and 44C, three pinch rollers 44P, three pinch rollers 44Q, and a curved guide surface 44G, which are disposed in respective positions along the U-turn portion of the conveyance path P1. In other words, the U-turn portion the conveyance path P1 is formed and defined by the three second feed rollers 44A, 44B, and 44C, the three pinch rollers 44P that are disposed to face the three second feed rollers 44A, 44B, and 44C, respectively, the three pinch rollers 44Q that are disposed to face the three second feed rollers 44A, 44B, and 44C, respectively, and the curved guide surface 44G that is curved while facing the three second feed rollers 44A, 44B, and 44C between the pinch rollers 44P and the pinch rollers 44Q. The second feed rollers 44A, 44B, and 44C are located downstream relative to the separation roller 32 in the conveyance direction.

As shown in FIG. 3, the second feed rollers 44A, 44B, and 44C are coaxially arranged in the front-to-rear direction. A distance W3 between a rear end face of the forefront second feed roller 44A and a front end face of the rearmost second feed roller 44C is less than the distance W1 and more than the distance W2.

Each pinch roller 44P is disposed to contact a corresponding one of the second feed rollers 44A, 44B, and 44C from an upper left side. Each pinch roller 44Q is disposed to contact a corresponding one of the second feed rollers 44A, 44B, and 44C from a lower left side.

The second feed rollers 44A, 44B, and 44C, the three pinch rollers 44P, the three pinch rollers 44Q, and the curved guide surface 44G receives a sheet SH fed by the first feed roller 43 and the pinch roller 43P, and makes the sheet SH U-turn toward the reading surface 8B.

At this time, as shown in FIG. 3, when the distance between the two guides 60A and 60B is enlarged to the distance W1, since the distance W3 is less than the distance W1, all the second feed rollers 44A, 44B, and 44C contact the sheet SH and provide a feeding force to the sheet SH. Meanwhile, when the distance between the two guides 60A and 60B is reduced to the distance W2, since the distance W3 is more than the distance W2, only the central second feed roller 44B of the second feed rollers 44A, 44B, and 44C contacts the sheet SH and provides a feeding force to the sheet SH.

Namely, the number of rollers of the second feed rollers 44A, 44B, and 44C that are allowed to contact the sheet SH fed by the separation roller 42 decreases to one from three in response to the distance between the two guides 60A and 60B being reduced to the distance W2 from the distance W1 As a result, when the width of the sheet SH is as large as the distance W2, the feeding force that the second feed rollers 44A, 44B, and 44C are allowed to provide to the sheet SH is less than when the width of the sheet SH is as large as the distance W1.

Subsequently, as shown in FIG. 2, the conveyance path P1 includes a rightward-extending portion that extends rightward with a small length along the reading surface 8B, following the U-turn portion. The feeding section 4 includes a pressing member 49 disposed in a position along the rightward-extending portion of the conveyance path P1 so as to face the reading surface 8B of the platen glass 7 from above. Namely, the mutually facing two elements, i.e., the reading surface 8B and the pressing member 49 form a part of the conveyance path P1. The pressing member 49 is urged toward the reading surface 8B by an urging spring 49S. The pressing member 49 is configured to press a sheet SH being conveyed by the second feed rollers 44A, 44B, and 44C, the pinch roller 44P, and the pinch roller 44Q from above, and to bring the sheet SH into contact with the reading surface 8B. The reading section 3, which faces the reading surface 8B from beneath in the reading position, is positioned downstream relative to the separation roller 42 in the conveyance direction.

Next, the conveyance path P1 includes an upward-inclined portion that extends inclined upward to the right up to the ejection section 9B. The feeding section 4 includes an ejection roller 45 and a pinch roller 45P disposed in respective positions along the upward-inclined portion of the conveyance path P1. Namely, the ejection roller 45 and the pinch roller 45P form a part of the conveyance path P1. Further, the ejection roller 45 and the pinch roller 45P are configured to eject onto the ejection section 9B a sheet SH fed in contact with the reading surface 8B.

<Image Reading Operation>

As shown in FIG. 2, when reading an image on a sheet supported by the supporting surface 8A, the image reader 1 causes the scanning mechanism (not shown) to move the reading section 3 from the left end portion to the right end portion in the reading unit 30. Thereby, the reading section 3 is allowed to read the image on the sheet supported by the supporting surface 8A. Thereafter, the scanning mechanism (not shown) causes the reading section 3, which has completed the reading operation, to move from the right end portion leftward to the original position in the reading unit 30.

Further, in the image reader 1, when reading images while feeding a plurality of sheets SH placed on the feed tray 9A, as shown in FIG. 2, the scanning mechanism (not shown) operates and stops the reading section 3 in the reading position. Then, when the feeding section 4 sequentially feeds the sheets SH placed on the feed tray 9A along the conveyance path P1, each sheet passes over the reading section 3 staying in the reading position, while contacting the reading surface 8B. At this time, the reading section 3 reads out an image of the sheet SH passing over the reading section 3.

<Specific Configurations of Pressing Mechanism and Adjuster>

As shown in FIGS. 2, 5, and 6, the pressing mechanism 100 includes a first pressing portion 110. The first pressing portion 110 is located downstream relative to the second axis X2 in the conveyance direction, i.e., on the left side of the second axis X2. The first pressing portion 110 is a compressive coil spring. An upper end portion of the first pressing portion engages with a lower face of the holder 21 at the left side of the second axis X2. A lower end portion of the first pressing portion 110 engages with the inner frame of the opening-closing section 9. The first pressing portion 110 generates a first urging force F1 to urge the holder 21 in the first swing direction D1, i.e., to urge a left portion of the holder 21 with respect to the second axis X2 up toward the separation roller 42.

As shown in FIGS. 4A, 4B, 5, and 6, the adjuster 102 includes a second pressing portion 120. The second pressing portion 120 includes a transmission portion 127 and a torsion coil spring 121.

A middle coil portion of the torsion coil spring 121A is supported by the inner frame of the opening-closing section 9, on a right side of the second axis X2. A left end portion of the torsion coil spring 121 contacts a right portion of the holder 21 with respect to the second axis X2 from beneath. A right end portion of the torsion coil spring 121 protrudes rightward so as to become farther from the second axis X2. Above the right end portion of the torsion coil spring 121, disposed is a stopper 129 formed at the inner frame of the opening-closing section 9.

As shown in FIGS. 4A and 5, the torsion coil spring 121 is storing a restoring force for displacing the left end portion of the torsion coil spring 121 upward, in a state where the right end portion of the torsion coil spring 121 is in contact with the stopper 129. The second pressing portion 120 urges the holder 21 in the second swing direction D2 (opposite to the first swing direction D1) at an upstream side of the second axis X2 in the conveyance direction. In other words, the second pressing portion 120 urges the right portion of the holder 21 with respect to the second axis X2 upward by the left end portion of the torsion coil spring 121. Thus, the second pressing portion 120 generates a second urging force F2.

The pressing load F0 of the pressing mechanism 100 is defined by the first urging force F1 and the second urging force F2. Specifically, the pressing load F0 is defined based on a distance between the second axis X2 and a point of application of the first urging force F1, a distance between the second axis X2 and a point of application of the second urging force F2, a largeness (absolute value) of the first urging force F1, a direction of the first urging force F1, a largeness (absolute value) of the second urging force F2, and a direction of the second urging force F2. In the first illustrative embodiment, the pressing load F0 is determined by the first urging force F1 applied in the first swing direction D1 by the first pressing portion 110 being weakened by the second urging force F2 applied in the second swing direction D2 by the second pressing portion 120.

As shown in FIGS. 4A, 4B, 5, and 6, the transmission portion 127 is provided to the rear guide 60B. The transmission portion 127 is disposed on the back side (the downward-facing side) of the feed tray 9A. A part of the rear guide 60B passes through the guide rail 9G and extends to the back side (the downward-facing side) of the feed tray 9A. The guide 60B includes a joint portion 60D that extends leftward from a position on the back side (the downward-facing side) of the feed tray 9A. The transmission portion 127 is coupled with a left end portion of the joint portion 60D, and protrudes forward substantially in a rectangular column shape. Thereby, the transmission portion 127 moves in the front-to-rear direction integrated with the rear guide 60B, in response to movement of the rear guide 60B in the front-to-rear direction. In other words, the transmission portion 127 moves in the front-to-rear direction, in conjunction with movement of the two guides 60A and 60B in such directions as to enlarge the distance therebetween to the distance W1 or in such directions as to reduce the distance therebetween to the distance W2.

As shown in FIGS. 4A and 5, the right end portion of the torsion coil spring 121 becomes spaced apart from the transmission portion 127, when the two guides 60A and 60B move in such directions as to enlarge the distance therebetween to the distance W1 from the distance W2, i.e., when the rear guide 60B moves rearward.

As shown in FIGS. 4B and 6, the right end portion of the torsion coil spring 121 comes into contact with the transmission portion 127, when the two guides 60A and 60B move in such directions as to reduce the distance therebetween to the distance W2 from the distance W1, i.e., when the rear guide 60B moves frontward. A front end portion of the transmission portion 127 is inclined downward in the front-to-rear direction (from the front to the rear). The front end portion of the transmission portion 127 is configured to contact and press down the right end portion of the torsion coil spring 121. Thereby, the torsion coil spring 121 is twisted to store a larger restoring force. As a result, the second pressing portion 120 increases the second urging force F2, and urges the holder 21 in the second swing direction D2 by an increased second urging force F2. Therefore, the first urging force F1 applied by the first pressing portion 110 is further weakened by the increased second urging force F2 applied by the second pressing portion 120. Thus, the pressing load F0 is decreased.

<Operations and Advantageous Effects>

According to the image reader 1 of the first illustrative embodiment, as shown in FIGS. 4A, 4B, 5, and 6, the adjuster 102 disposed between the pressing mechanism 100 and the two guides 60A and 60B decreases the second urging force F2 and increases the pressing load F0 in conjunction with the two guides 60A and 60B positioning a large-size sheet as wide as the distance W1 in the front-to-rear direction, more specifically, in response to the transmission portion 127 of the second pressing portion 120 being separated from the torsion coil spring 121 along with the rearward movement of the guide 60B. Further, the adjuster 102 increases the second urging force F2 and decreases the pressing load F0 in conjunction with the two guides 60A and 60B positioning a small-size sheet as wide as the distance W2 in the front-to-rear direction, more specifically, in response to the transmission portion 127 of the second pressing portion 120 being brought into sliding contact with the torsion coil spring 121 along with the forward movement of the rear guide 60B.

Therefore, according to the image reader 1, a braking force applied when the small-size sheets SH as wide as the distance W2 are separated and fed is less than a braking force applied when the large-size sheets SH as wide as the distance W1 are separated and fed. Consequently, according to the image reader 1, when the small-size sheets SH as wide as the distance W2 are separated and fed, the pressing load F0 with a low value set for the small-size sheets SH is applied between the separation roller 42 and the separation pad 20. Thus, it is possible to prevent components such as the separation roller 42 and the separation pad 20 from being worn. Further, in the image reader 1, it is hardly likely that the braking force applied to the large-size sheet SH as wide as the distance W1 may be too small. Hence, it is less likely that there may be caused an undesired situation where sheets other than a sheet in contact with the separation roller 42 slip relative to the separation pad 20 when the separation roller 42 is about to concurrently feed a plurality of sheets SH. Thus, multi feed is less likely to be caused.

Accordingly, in the image reader 1 of the first illustrative embodiment, regardless of the width of the sheets SH, it is possible to feed the sheets SH in a manner successfully separated on a sheet-by-sheet basis and to prevent components such as the separation roller 42 and the separation pad 20 from being worn.

Further, according to the image reader 1, it is possible to easily achieve such a configuration as to press the separation pad 20 against the separation roller 42, using the holder 21 that is swingable around the second axis X2 located upstream in the conveyance direction relative to the contact point N1 between the separation roller 42 and the separation pad 20, and the first pressing portion 110 that is a compression coil spring.

Further, according to the image reader 1, it is possible to increase or decrease the second urging force F2 in a favorable manner, by a simple configuration that the torsion coil spring 121 is elastically deformed in response to the right end portion of the torsion coil spring 121 being brought into contact with or spaced apart from the transmission portion 127.

Further, according to the image reader 1, the number of the second feed rollers 44A, 44B, and 44C that contact the sheet SH being fed by the separation roller 42 is decreased to one from three, in response to the distance between the two guides 60A and 60B being reduced to the distance W2 from the distance W1. At this time, a feeding force applied to a small-size sheet SH as wide as the distance W2 when the small-size sheet SH is fed by the single second feed roller 44B is less than a feeding force applied to a large-size sheet SH as wide as the distance W1 when the large-size sheet SH is fed by the three second feed rollers 44A, 44B, and 44C. For instance, if the pressing load F0 applied to the separation roller 42 by the separation pad 20 were constant, the braking force applied to a sheet SH by the separation roller 42 and the separation pad 20 would be constant, and it would be impossible to maintain proper balance between the feeding force and the braking force depending on sheets SH with different widths. In this regard, according to the image reader 1 of the first illustrative embodiment, by the aforementioned configuration, in response to the distance between the two guides 60A and 60B in the front-to-rear direction being reduced to the distance W2 from the distance W1, the number of the second feed rollers 44A, 44B, and 44C that contact the sheet SH being fed by the separation roller 42 is decreased to one from three, and the pressing load F0 applied to the separation roller 42 by the separation pad 20 is decreased. Consequently, according to the image reader 1, in response to the feeding force applied to a small-size sheet SH as wide as the distance W2 when the small-size sheet SH is fed by the single second feed roller 44B being decreased, the braking force applied to the sheet SH by the separation roller 42 and the separation pad 20 is decreased. Thus, it is possible to maintain proper balance between the feeding force and the braking force depending on sheets SH with different widths.

Further, in the image reader 1, the reading section 3 reads images of sheets SH fed in a manner successfully separated on a sheet-by-sheet basis by the separation roller 42 and the separation pad 20. Thus, it is possible to achieve a constant level of image reading quality.

<Second Illustrative Embodiment>

As shown in FIGS. 7A, 7B, 8, and 9, in an image reader 1 of a second illustrative embodiment, instead of the second pressing portion 120 in the first illustrative embodiment, a second pressing portion 220 is employed. Other configurations (elements) in the second illustrative embodiment are the same as those in the first illustrative embodiment. Therefore, in the second illustrative embodiment, the same elements as those in the first illustrative embodiment will be provided with the same reference characters, and explanations thereof will be omitted or simplified.

The second pressing portion 220 is formed integrally with the rear guide 60B. The second pressing portion 220 is a beam member formed with a modified shape of the front end portion of the transmission portion 127 in the first illustrative embodiment. More specifically, the second pressing portion 220 includes a beam portion formed to extend leftward substantially in a beam shape from the front end portion of the transmission portion 127 in the first illustrative embodiment. Further, the second pressing portion 220 includes a contact portion 220A extending forward from a distal end portion of the beam portion. The contact portion 220A is inclined downward toward a front end thereof.

Figure 7A:
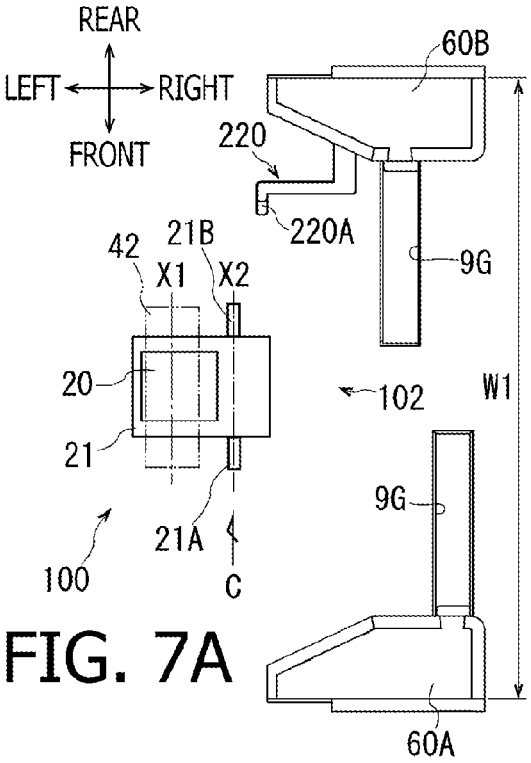
FIG. 7A is a top view showing a pressing mechanism in a state where a second urging force applied by a second pressing portion is decreased to zero in response to the two guides moving in such directions as to enlarge the distance between the two guides in a second illustrative embodiment according to one or more aspects of the present disclosure.
Figure 8:
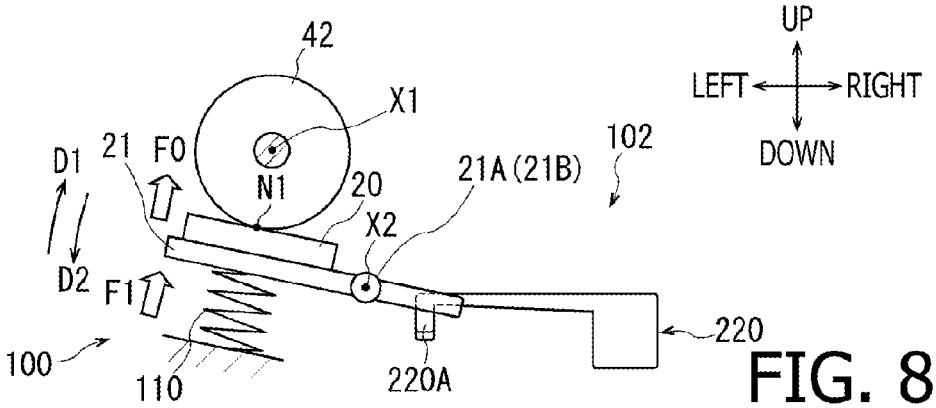
FIG. 8 is a front view of the pressing mechanism when viewed in a direction of an arrow C shown in FIG. 7A in the second illustrative embodiment according to one or more aspects of the present disclosure.

As shown in FIGS. 7A and 8, when the two guides 60A and 60B move in such directions as to enlarge the distance therebetween to the distance W1 from the distance W2, i.e., when the rear guide 60B moves rearward, the contact portion 220A of the second pressing portion 220 becomes spaced apart from the right portion of the holder 21 with respect to the second axis X2. In this situation, a second urging force F2 to be applied by the second pressing portion 220 is zero. In this case, the pressing load F0 is determined by the first urging force F1 applied in the first swing direction D1 by the first pressing portion 110.

Figure 7B:
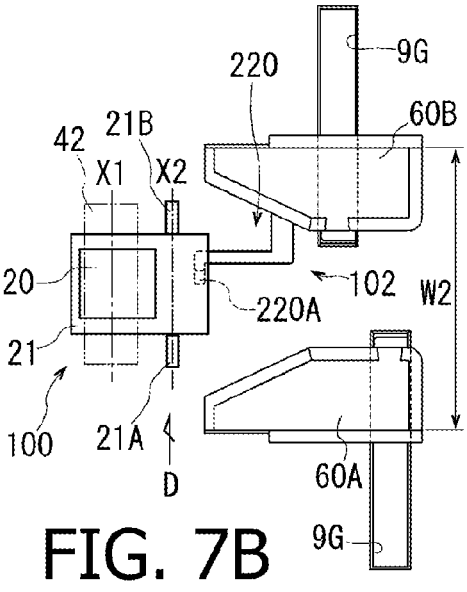
FIG. 7B is a top view showing the pressing mechanism in a state where the second urging force applied by the second pressing portion is increased from zero in response to the two guides moving in such directions as to reduce the distance between the two guides in the second illustrative embodiment according to one or more aspects of the present disclosure.
Figure 9:
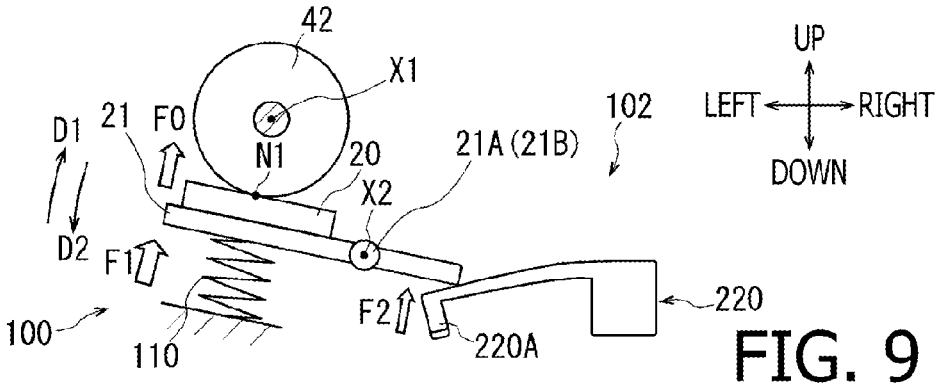
FIG. 9 is a front view of the pressing mechanism when viewed in a direction of an arrow D shown in FIG. 7B in the second illustrative embodiment according to one or more aspects of the present disclosure.

As shown in FIGS. 7B and 9, when the two guides 60A and 60B move in such directions as to reduce the distance therebetween to the distance W2 from the distance W1, i.e., when the rear guide 60B moves forward, the contact portion 220A of the second pressing portion 220 comes into contact with a lower surface of the right portion of the holder 21 with respect to the second axis X2. As described above, the contact portion 220A of the second pressing portion 220 is inclined downward toward the front end thereof. Therefore, when the second pressing portion 220 begins to come into sliding contact with the right portion of the holder 21 with respect to the second axis X2, the second pressing portion 220 gradually lifts up the right portion of the holder 21 along the inclined shape of the contact portion 220A, so as to generate the second urging force F2. At this time, an elastic force (an elastically bent state) of the beam portion of the second pressing portion 220 effectively contributes to lifting up the right portion of the holder 21. Thus, the second pressing portion 220 increases the second urging force F2 from zero, and urges the holder 21 in the second swing direction D2 by the second urging force F2. Therefore, the first urging force F1 of the first pressing portion 110 is weakened by the second urging force F2 increased from zero as the second pressing portion 220 moves forward while sliding in contact with the right portion of the holder 21. Thereby, the pressing load F0 is decreased.

Even in the image reader 1 configured as above in the second illustrative embodiment, it is possible to provide the same effects as those in the first illustrative embodiment.

(Third Illustrative Embodiment)

As shown in FIGS. 10A, 10B, 11, and 12, in an image reader 1 of a third illustrative embodiment, instead of the second pressing portion 120 of the image reader 1 in the first illustrative embodiment, a second pressing portion 320 is employed. Other configurations (elements) in the third illustrative embodiment are the same as those in the first illustrative embodiment. Therefore, in the third illustrative embodiment, the same elements as those in the first illustrative embodiment will be provided with the same reference characters, and explanations thereof will be omitted or simplified.

The second pressing portion 320 includes a transmission portion 327 and a beam member 321. The transmission portion 327 is inclined upward toward a rear side from a front end thereof, unlike the transmission portion 127 of the first illustrative embodiment that is inclined downward in the front-to-rear direction (from the front to the rear). The beam member 321 is formed integrally with the holder 21 made of resin material. The beam member 321 is a rod-shaped member formed to extend rightward substantially in a beam shape from a right end portion of the holder 21. The beam member 321 is configured to be elastically deformed.

Figure 10A:
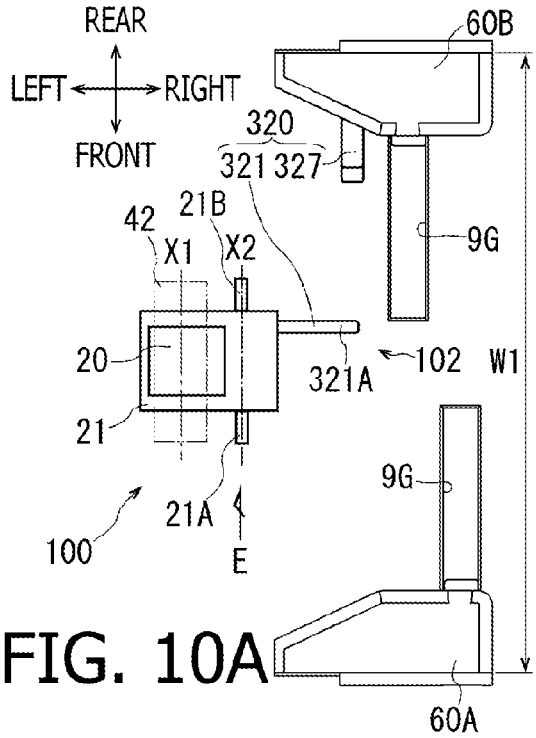
FIG. 10A is a top view showing a pressing mechanism in a state where a second urging force applied by a second pressing portion is decreased to zero in response to the two guides moving in such directions as to enlarge the distance between the two guides in a third illustrative embodiment according to one or more aspects of the present disclosure.
Figure 11:
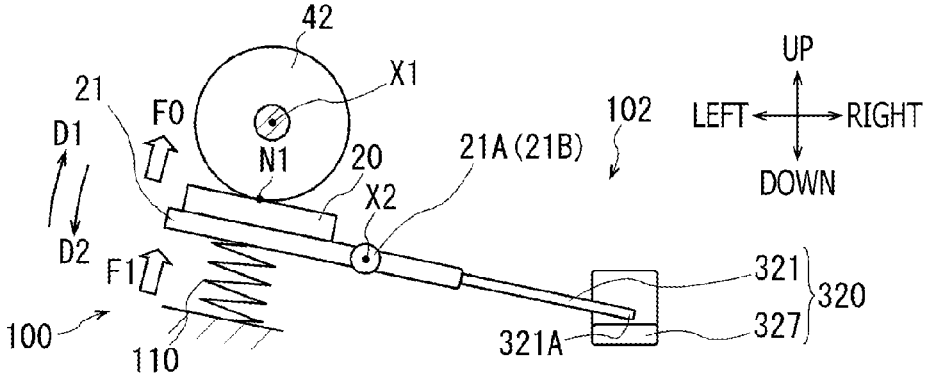
FIG. 11 is a front view of the pressing mechanism when viewed in a direction of an arrow E shown in FIG. 10A in the third illustrative embodiment according to one or more aspects of the present disclosure.

As shown in FIGS. 10A and 11, when the two guides 60A and 60B move in such directions as to enlarge the distance therebetween to the distance W1 from the distance W2, i.e., when the rear guide 60B moves rearward, the transmission portion 327 becomes spaced apart from a right end portion 321A of the beam member 321. In this situation, a second urging force F2 to be applied by the second pressing portion 320 is zero. In this case, the pressing load F0 is determined by the first urging force F1 applied in the first swing direction D1 by the first pressing portion 110.

Figure 10B:
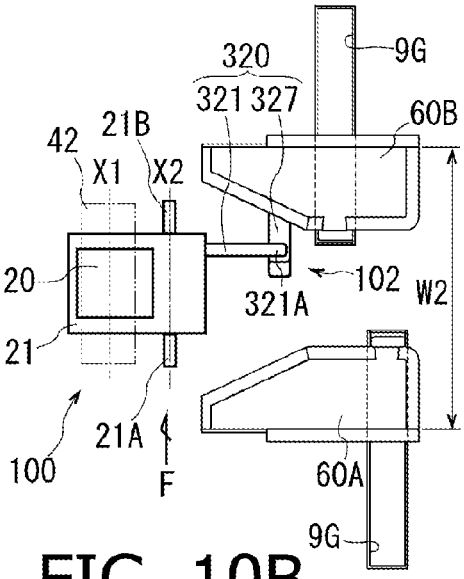
FIG. 10B is a top view showing the pressing mechanism in a state where the second urging force applied by the second pressing portion is increased from zero in response to the two guides moving in such directions as to reduce the distance between the two guides in the third illustrative embodiment according to one or more aspects of the present disclosure.
Figure 12:
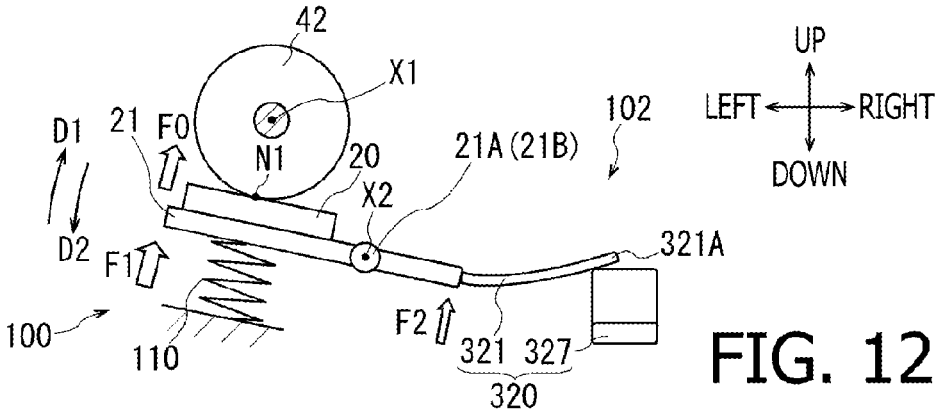
FIG. 12 is a front view of the pressing mechanism when viewed in a direction of an arrow F shown in FIG. 10B in the third illustrative embodiment according to one or more aspects of the present disclosure.

As shown in FIGS. 10B and 12, when the two guides 60A and 60B move in such directions as to reduce the distance therebetween to the distance W2 from the distance W1, i.e., when the rear guide 60B moves forward, the transmission portion 327 comes into sliding contact with the right end portion 321A of the beam member 321. Then, by a front end portion inclined upward toward the rear side from the front end thereof, the transmission portion 327 lifts up the right end portion 321A of the beam member 321 and bends the beam member. Thus, as the beam member 321 is bent, the second pressing portion 320 generates the second urging force F2 to lift up the right portion of the holder 21 with respect to the second axis X2. Thereby, the second pressing portion 320 increases the second urging force F2 from zero, and urges the holder 21 in the second swing direction D2 by the second urging force F2. Therefore, the first urging force F1 of the first pressing portion 110 is weakened by the second urging force F2 increased from zero as the second pressing portion 220 is getting under the right portion of the holder 21. Thereby, the pressing load F0 is decreased.

Even in the image reader 1 configured as above in the third illustrative embodiment, it is possible to provide the same effects as those in the first illustrative embodiment.

(Forth Illustrative Embodiment)

As shown in FIGS. 13A, 13B, 14, and 15, in an image reader 1 of a fourth illustrative embodiment, instead of the second pressing portion 120 of the image reader 1 in the first illustrative embodiment, a second pressing portion 420 is employed. Other configurations (elements) in the fourth illustrative embodiment are the same as those in the first illustrative embodiment. Therefore, in the fourth illustrative embodiment, the same elements as those in the first illustrative embodiment will be provided with the same reference characters, and explanations thereof will be omitted or simplified.

The second pressing portion 420 includes a transmission portion 427 and a mass body 421. The transmission portion 427 is inclined upward toward a rear side from a front end thereof, unlike the transmission portion 127 of the first illustrative embodiment that is inclined downward in the front-to-rear direction (from the front to the rear). The transmission portion 427 is enlarged in a leftward direction and a frontward direction, in comparison with the transmission portion 127 of the first illustrative embodiment. The mass body 421 is suspended by the inner frame of the opening-closing section 9 in a manner displaceable in the vertical direction. The mass body 421 is formed in a block shape having a longitudinal direction along the left-to-right direction. The mass body 421 includes a step portion 421A formed at a lower left end portion thereof to be recessed upward and rightward.

Figure 13A:
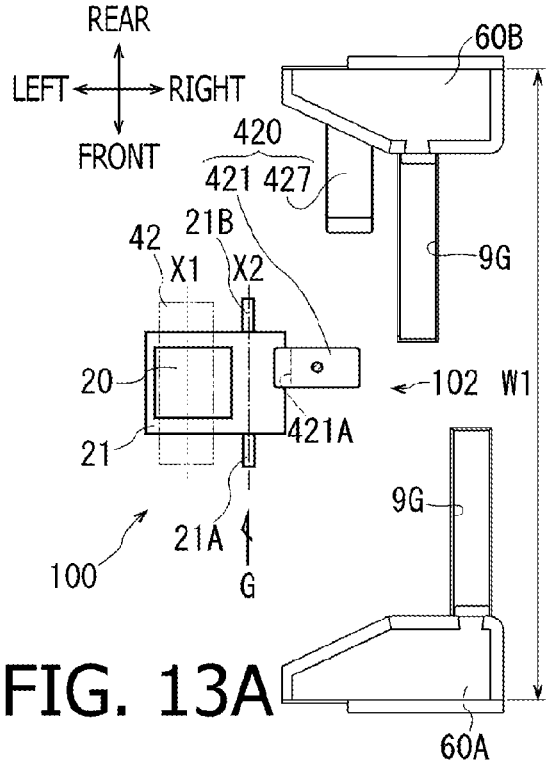
FIG. 13A is a top view showing a pressing mechanism in a state where a second urging force applied by a second pressing portion is increased from zero in response to the two guides moving in such directions as to enlarge the distance between the two guides in a fourth illustrative embodiment according to one or more aspects of the present disclosure.
Figure 14:
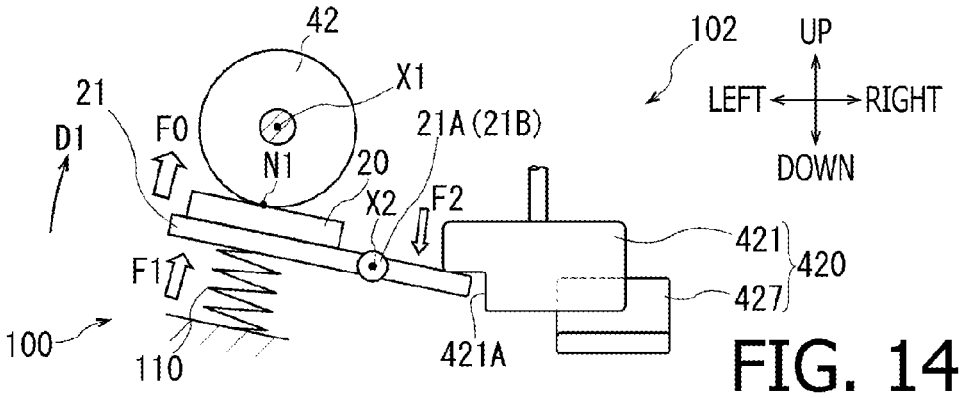
FIG. 14 is a front view of the pressing mechanism when viewed in a direction of an arrow G shown in FIG. 13A in the fourth illustrative embodiment according to one or more aspects of the present disclosure.

As shown in FIGS. 13A and 14, when the two guides 60A and 60B move in such directions as to enlarge the distance therebetween to the distance W1 from the distance W2, i.e., when the rear guide 60B moves rearward, the transmission portion 427 becomes spaced apart from the mass body 421. In this situation, the step portion 421A of the mass body 421 contacts the right end portion of the holder 21 from above. The second pressing portion 420 urges the right end portion of the holder 21 downward by a weight of the mass body 421. Thus, the second pressing portion 420 generates a second urging force F2. Therefore, the pressing load F0 is determined by the first urging force F1 applied in the first swing direction D1 by the first pressing portion 110 being assisted by the second urging force F2 applied in the first swing direction by the second pressing portion 420.

Figure 13B:
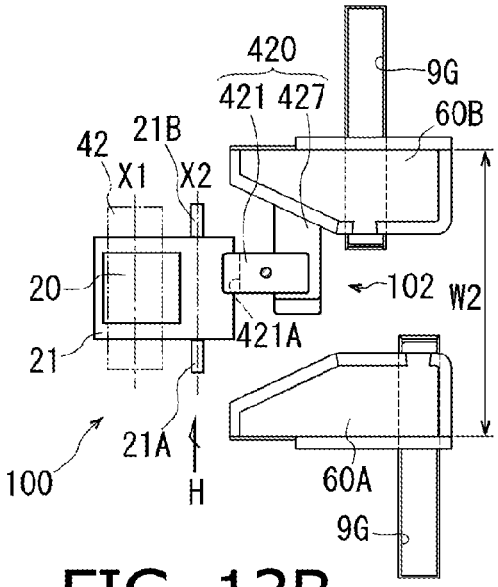
FIG. 13B is a top view showing the pressing mechanism in a state where the second urging force applied by the second pressing portion is decreased to zero in response to the two guides moving in such directions as to reduce the distance between the two guides in the fourth illustrative embodiment according to one or more aspects of the present disclosure.
Figure 15:
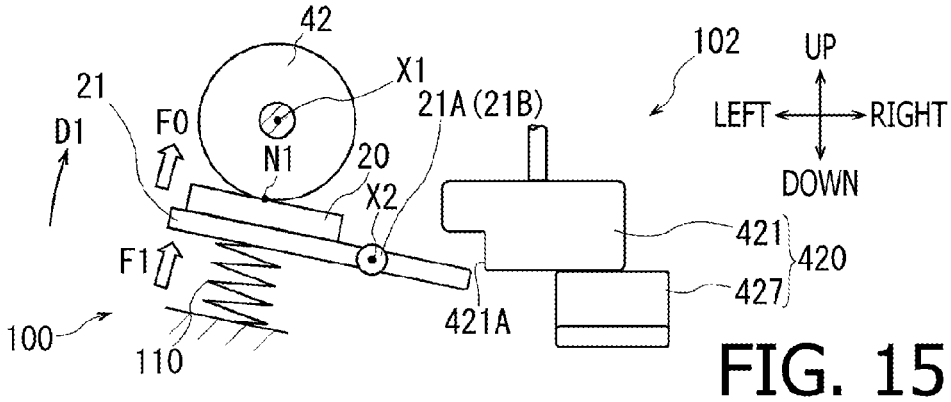
FIG. 15 is a front view of the pressing mechanism when viewed in a direction of an arrow H shown in FIG. 13B in the fourth illustrative embodiment according to one or more aspects of the present disclosure.

As shown in FIGS. 13B and 15, when the two guides 60A and 60B move in such directions as to reduce the distance therebetween to the distance W2 from the distance W1, i.e., when the rear guide 60B moves forward, the transmission portion 427 comes into sliding contact with a lower surface of the mass body 421. Then, the transmission portion 427 lifts up the mass body 421 by a front end portion of the transmission portion 427 that is inclined upward toward the rear side from the front end thereof. Thereby, the step portion 421A is spaced apart from the holder 21. As a result, the weight of the mass body 421 is not loaded on the right end portion of the holder 21. Thus, since the second urging force F2, which has been applied by the second pressing portion 420 to assist the first urging force F1 of the first pressing portion 110 in a state as shown in FIGS. 13A and 14, is decreased to zero, the pressing load F0 is decreased.

Even in the image reader 1 configured as above in the fourth illustrative embodiment, it is possible to provide the same effects as those in the first illustrative embodiment.

(Fifth Illustrative Embodiment)

As shown in FIGS. 16A, 16B, 17, and 18, in an image reader 1 of a fifth illustrative embodiment, instead of the second pressing portion 120 of the image reader 1 in the first illustrative embodiment, a second pressing portion 520 is employed. Other configurations (elements) in the fifth illustrative embodiment are the same as those in the first illustrative embodiment. Therefore, in the fifth illustrative embodiment, the same elements as those in the first illustrative embodiment will be provided with the same reference characters, and explanations thereof will be omitted or simplified.

The second pressing portion 520 includes a transmission portion 527, a tensile coil spring 521, and a lever 523. The transmission portion 527 is inclined upward toward a rear side from a front end thereof, unlike the transmission portion 127 of the first illustrative embodiment that is inclined downward in the front-to-rear direction (from the front to the rear).

An upper end portion of the tensile coil spring 521 engages with the lower surface of the holder 21 at a left side of the second axis X2. A lower end portion of the tensile coil spring 521 engages with a left end portion of the lever 523.

The lever 523 is formed to extend rightward in a rod shape. A middle portion of the lever 523 is supported by the inner frame of the opening-closing section 9 so as to be swingable around a third axis X3. The third axis X3 is located on a right side of the second axis X2, and extends in parallel with the second axis X2. By a resting force of the tensile coil spring 521, the lever 523 is urged in a third swing direction D3 around the third axis X3. The lever 523 is configured to contact a stopper 529 protruding from the inner frame of the opening-closing section 9, on a left side of the third axis X3.

Figure 16A:
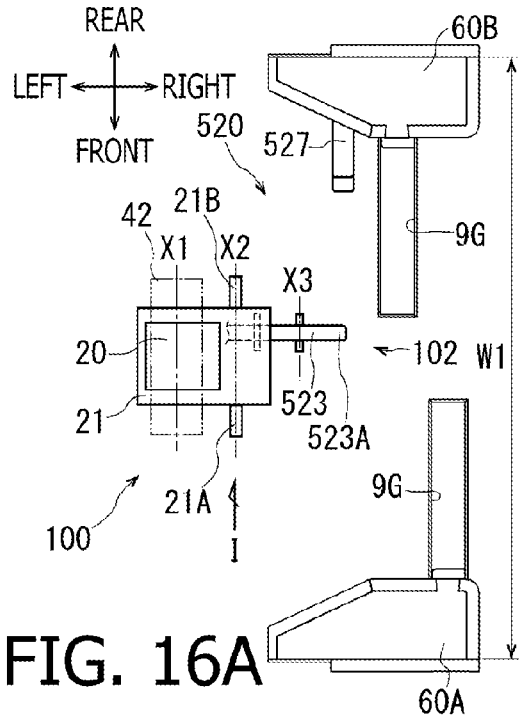
FIG. 16A is a top view showing a pressing mechanism in a state where a second urging force applied by a second pressing portion is decreased in response to the two guides moving in such directions as to enlarge the distance between the two guides in a fifth illustrative embodiment according to one or more aspects of the present disclosure.
Figure 17:
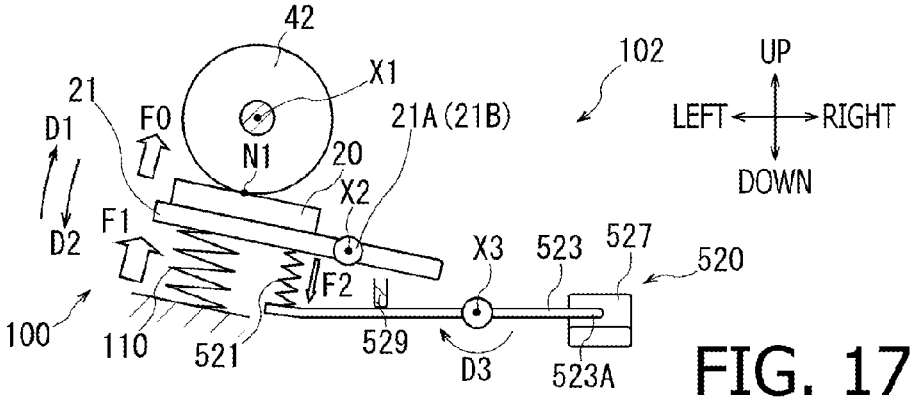
FIG. 17 is a front view of the pressing mechanism when viewed in a direction of an arrow I shown in FIG. 16A in the fifth illustrative embodiment according to one or more aspects of the present disclosure.

As shown in FIGS. 16A and 17, when the two guides 60A and 60B move in such directions as to enlarge the distance therebetween to the distance W1 from the distance W2, i.e., when the rear guide 60B moves rearward, the transmission portion 527 becomes spaced apart from the right end portion 523A of the lever 523. In this situation, the second pressing portion 520 urges the holder 21 in the second swing direction D2 (opposite to the first swing direction D1) at a downstream side of the second axis X2 in the conveyance direction. In other words, the second pressing portion 520 urges a left portion of the holder 21 with respect to the second axis X2 downward by the tensile coil spring 521. Thus, the second pressing portion 520 generates a second urging force F2. Therefore, the pressing load F0 is determined by the first urging force F1 applied in the first swing direction D1 by the first pressing portion 110 being weakened by the second urging force F2 applied in the second swing direction D2 by the second pressing portion 520.

Figure 16B:
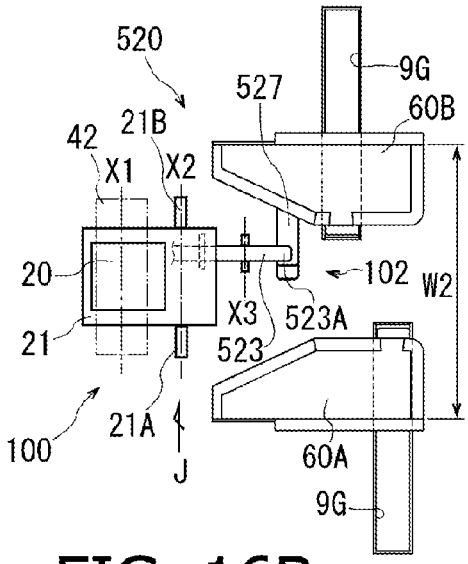
FIG. 16B is a top view showing the pressing mechanism in a state where the second urging force applied by the second pressing portion is increased in response to the two guides moving in such directions as to reduce the distance between the two guides in the fifth illustrative embodiment according to one or more aspects of the present disclosure.
Figure 18:
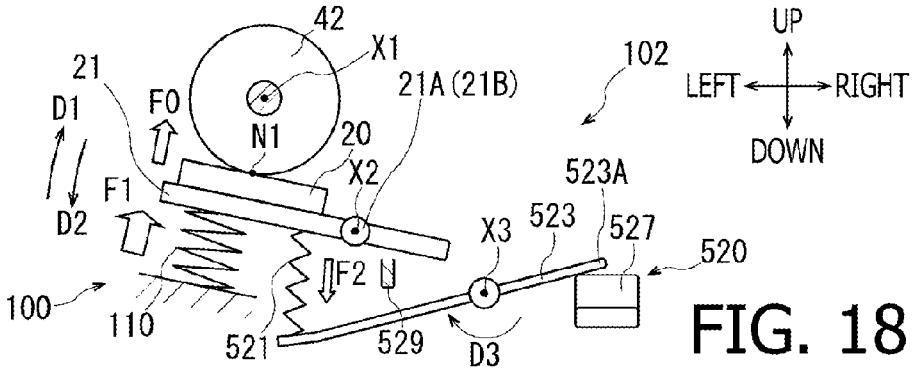
FIG. 18 is a front view of the pressing mechanism when viewed in a direction of an arrow J shown in FIG. 16B in the fifth illustrative embodiment according to one or more aspects of the present disclosure.

As shown in FIGS. 16B and 18, when the two guides 60A and 60B move in such directions as to reduce the distance therebetween to the distance W2 from the distance W1, i.e., when the rear guide 60B moves forward, the transmission portion 527 comes into sliding contact with the right end portion 523A of the lever 523. Then, the transmission portion 527 lifts up the right end portion 523A of the lever 523 by a front end portion of the transmission portion 527 that is inclined upward toward the rear side from the front end thereof, and swings the lever 523 in a direction opposite to the third swing direction D3. As a result, the tensile coil spring 521 is pulled and extended by the lever 523 to become longer. Consequently, the second pressing portion 520 increases the second urging force F2, and urges the holder 21 in the second swing direction D2 by the increased second urging force F2. Therefore, the first urging force F1 applied by the first pressing portion 110 is further weakened by the increased second urging force F2 applied by the second pressing portion 520. Thus, the pressing load F0 is decreased.

Even in the image reader 1 configured as above in the fifth illustrative embodiment, it is possible to provide the same effects as those in the first illustrative embodiment.

(Sixth Illustrative Embodiment)

Figure 19:
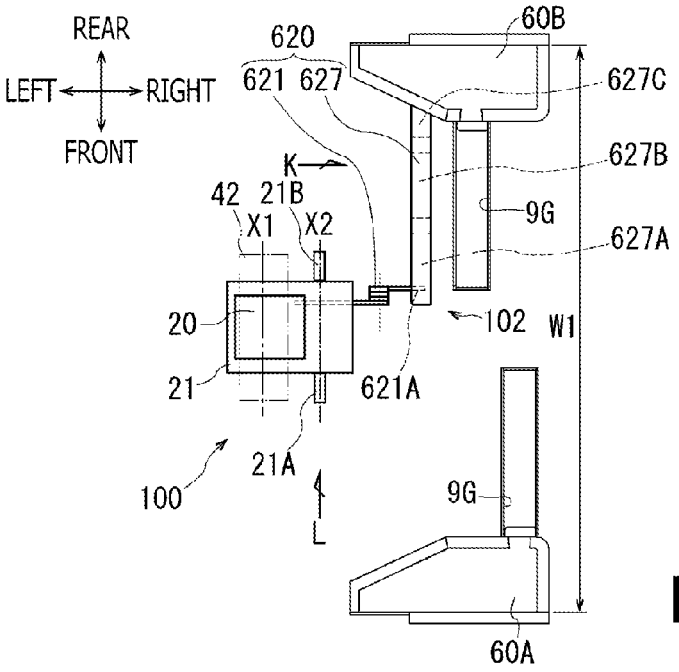
FIG. 19 is a top view showing a pressing mechanism in a state where a second urging force applied by a second pressing portion is decreased in response to the two guides moving in such directions as to enlarge the distance between the two guides in a sixth illustrative embodiment according to one or more aspects of the present disclosure.
Figure 20:
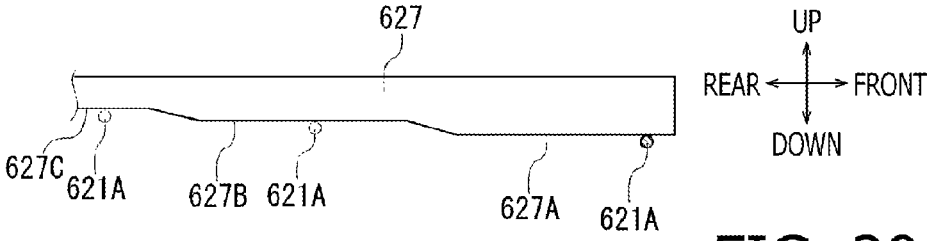
FIG. 20 is a side view showing a part of the pressing mechanism when viewed in a direction of an arrow K shown in FIG. 19 in the sixth illustrative embodiment according to one or more aspects of the present disclosure.
Figure 21:
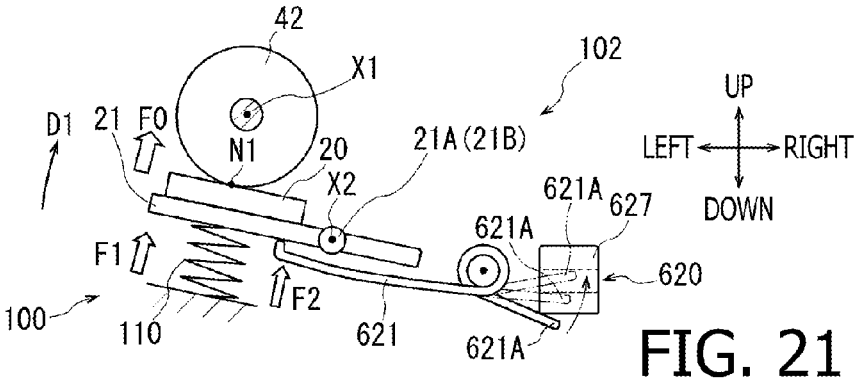
FIG. 21 is a front view of the pressing mechanism when viewed in a direction of an arrow L shown in FIG. 19 in the sixth illustrative embodiment according to one or more aspects of the present disclosure.

As shown in FIGS. 19, 20, and 21, in an image reader 1 of a sixth illustrative embodiment, instead of the second pressing portion 120 of the image reader 1 in the first illustrative embodiment, a second pressing portion 620 is employed. Other configurations (elements) in the sixth illustrative embodiment are the same as those in the first illustrative embodiment. Therefore, in the sixth illustrative embodiment, the same elements as those in the first illustrative embodiment will be provided with the same reference characters, and explanations thereof will be omitted or simplified.

The second pressing portion 620 includes a transmission portion 627 and a torsion coil spring 621. The transmission portion 627 protrudes forward longer than the transmission portion 127 of the first illustrative embodiment. On a lower surface of the transmission portion 627, formed are a first horizontal surface 627A, a second horizontal surface 627B, and a third horizontal surface 627C. The first horizontal surface 627A substantially horizontally extends rearward from a front end portion of the transmission portion 627. The second horizontal surface 627B is continuous with the first horizontal surface 627A via an upward-inclined surface. The second horizontal surface 627B substantially horizontally extends rearward on an upper rear side of the first horizontal surface 627A. The third horizontal surface 627C is continuous with the second horizontal surface 627B via an upward-inclined surface. The third horizontal surface 627C substantially horizontally extends rearward on an upper rear side of the second horizontal surface 627B.

A middle coil portion of the torsion coil spring 621 is supported by the inner frame of the opening-closing section 9, on a right side of the second axis X2. A left end portion of the torsion coil spring 621 contacts the left portion of the holder 21 with respect to the second axis X2 from beneath. A right end portion of the torsion coil spring 621 protrudes rightward so as to become farther from the second axis X2.

When the distance between the two guides 60A and 60B is the distance W1, the first horizontal surface 627A of the transmission portion 627 contacts a right end portion 621A of the torsion coil spring 621 from above. In this case, the torsion coil spring 621 stores a restoring force to displace a left end portion thereof upward. The second pressing portion 620 urges the holder 21 in the first swing direction D1 at the downstream side of the second axis X2 in the conveyance direction. In other words, the second pressing portion 620 urges the left portion of the holder 21 with respect to the second axis X2 upward by the left end portion of the torsion coil spring 621. Thus, the second pressing portion 620 generates a second urging force F2. Therefore, the first urging force F1 applied in the first swing direction D1 by the first pressing portion 110 is assisted by the second urging force F2 applied in the first swing direction D1 by the second pressing portion 620. Thus, the pressing load F0 is determined.

When the two guides 60A and 60B move in such direction as to reduce the distance therebetween to the distance W2 from the distance W1, the right end portion 621A of the torsion coil spring 621 slides relative to and in contact with the transmission portion 627. Therefore, the second horizontal surface 627B of the transmission portion 627 contacts the right end portion 621A of the torsion coil spring 621 from above. Further, the third horizontal surface 627C of the transmission portion 627 contacts the right end portion 621A of the torsion coil spring 621 from above. Thus, the torsion coil spring 621 is deformed to reduce its torsion, and the restoring force stored in the torsion coil spring 621 is decreased in a step-by-step manner. Therefore, a degree to which the first urging force F1 applied by the first pressing portion 110 is assisted by the second urging force F2 applied by the second pressing portion 120 is reduced in a step-by-step manner, and the pressing load F0 is decreased in stages. By using this configuration, it is possible to set the pressing load F0 depending on a plurality of sheet sizes.

Even in the image reader 1 configured as above in the sixth illustrative embodiment, it is possible to provide the same effects as those in the first illustrative embodiment.

Hereinabove, the illustrative embodiments according to aspects of the present disclosure have been described. The present disclosure can be practiced by employing conventional materials, methodology and equipment. Accordingly, the details of such materials, equipment and methodology are not set forth herein in detail. In the previous descriptions, numerous specific details are set forth, such as specific materials, structures, chemicals, processes, etc., in order to provide a thorough understanding of the present disclosure. However, it should be recognized that the present disclosure can be practiced without reapportioning to the details specifically set forth. In other instances, well known processing structures have not been described in detail, in order not to unnecessarily obscure the present disclosure.

Only exemplary embodiments of the present disclosure and but a few examples of their versatility are shown and described in the present disclosure. It is to be understood that the present disclosure is capable of use in various other combinations and environments and is capable of changes or modifications within the scope of the inventive concept as expressed herein.

For instance, the adjuster 102 may be configured to detect the distance between the two guides 60A and 60B with a sensor, and operate an electric actuator based on the detection result to adjust the pressing load F0 applied by the pressing mechanism 100.

What is claimed is:

1. A sheet separator comprising:

a supporter configured to support one or more sheets;

two guides provided to the supporter, the two guides being disposed to face each other across a distance in a width direction of the one or more sheets supported by the supporter, at least one of the two guides being configured to move along the width direction to enlarge or reduce the distance between the two guides in the width direction, and position the one or more sheets supported by the supporter in the width direction;

a separation roller configured to rotate around a first axis parallel to the width direction, and convey the one or more sheets supported by the supporter in a conveyance direction;

a separation pad configured to separate sheets being conveyed by the separation roller, on a sheet-by-sheet basis in cooperation with the separation roller;

a holder configured to:

swing around a second axis parallel to the first axis;

hold the separation pad by a first end portion of the holder in the conveyance direction; and apply a pressing load to press the separation pad against the separation roller;

a first pressing portion configured to be elastically deformed and apply a first urging force to the first end portion of the holder in the conveyance direction from a specific side of the holder, the specific side being opposite to a side of the holder facing the separation roller; and a second pressing portion disposed between the holder and the two guides, the second pressing portion being configured to be elastically deformed and apply a second urging force to a second end portion of the holder in the conveyance direction from the specific side of the holder, the second end portion being opposite to the first end portion with respect to the second axis, wherein the pressing load is determined by the first urging force and the second urging force, and wherein the second pressing portion is configured to:

change the second urging force by displacing the second pressing portion in response to movement of the at least one of the two guides;

increase the pressing load in response to the at least one of the two guides moving in a direction to enlarge the distance between the two guides; and decrease the pressing load in response to the at least one of the two guides moving in a direction to reduce the distance between the two guides.

2. The sheet separator according to claim 1, wherein the second axis is located upstream in the conveyance direction relative to a contact point between the separation roller and the separation pad, wherein the separation pad is configured to become closer to the separation roller when the holder swings in a first swing direction, and wherein the first pressing portion is disposed at a downstream side of the second axis in the conveyance direction, and configured to urge the holder in the first swing direction and generate the first urging force.

3. The sheet separator according to claim 2, wherein the second pressing portion is configured to:

generate the second urging force by urging the holder in a second swing direction opposite to the first swing direction at an upstream side of the second axis in the conveyance direction;

decrease the second urging force in response to the at least one of the two guides moving in the direction to enlarge the distance between the two guides; and increase the second urging force to decrease the pressing load in response to the at least one of the two guides moving in the direction to reduce the distance between the two guides.

4. The sheet separator according to claim 1, wherein the second pressing portion comprises:

a transmission portion provided to the at least one of the two guides, the transmission portion being configured to move along the width direction in response to the at least one of the two guides moving in the direction to enlarge the distance between the two guides or in the direction to reduce the distance between the two guides; and an elastic member comprising:

a first end portion configured to engage with the holder; and a second end portion configured to be brought into contact with or spaced apart from the transmission portion.

5. The sheet separator according to claim 1, wherein the second pressing portion comprises:

a transmission portion provided to the at least one of the two guides, the transmission portion being configured to move along the width direction in response to the at least one of the two guides moving in the direction to enlarge the distance between the two guides or in the direction to reduce the distance between the two guides; and a mass body configured to load a weight of the mass body on the holder, the mass body being further configured to be brought into contact with or spaced apart from the transmission portion.

6. The sheet separator according to claim 1, wherein the second pressing portion comprises a beam portion formed integrally with the at least one of the two guides and extending substantially in a beam shape, the beam portion being configured to be brought into contact with or spaced apart from the holder.

7. The sheet separator according to claim 1, wherein the second pressing portion comprises:

a transmission portion provided to the at least one of the two guides, the transmission portion being configured to move along the width direction in response to the at least one of the two guides moving in the direction to enlarge the distance between the two guides or in the direction to reduce the distance between the two guides; and a beam member formed integrally with the holder, the beam member being configured to be brought into contact with or spaced apart from the transmission portion.

8. The sheet separator according to claim 1, further comprising a plurality of feed rollers disposed downstream in the conveyance direction relative to the separation roller, the plurality of feed rollers being coaxially arranged in the width direction, wherein a number of feed rollers that contact the one or more sheets conveyed by the separation roller, of the plurality of feed rollers, is decreased in response to reduction in the distance between the two guides in the width direction.

9. The sheet separator according to claim 1, further comprising a reading section disposed downstream in the conveyance direction relative to the separation roller, the reading section being configured to read images of the one or more sheets conveyed by the separation roller.

10. A sheet separator comprising:

a supporter configured to support one or more sheets;

two guides provided to the supporter, the two guides being disposed to face each other across a distance in a width direction of the one or more sheets supported by the supporter, at least one of the two guides being configured to move along the width direction to enlarge or reduce the distance between the two guides in the width direction, and position the one or more sheets supported by the supporter in the width direction;

a separation roller configured to rotate around a first axis parallel to the width direction, and convey the one or more sheets supported by the supporter in a conveyance direction;

a separation pad configured to separate sheets being conveyed by the separation roller, on a sheet-by-sheet basis in cooperation with the separation roller;

a holder configured to hold the separation pad in a manner capable of being closer to or farther from the separation roller;

a pressing mechanism configured to apply a pressing load to press the holder toward the separation roller; and an adjuster configured to increase the pressing load in response to the at least one of the two guides moving in a direction to enlarge the distance between the two guides, and decrease the pressing load in response to the at least one of the two guides moving in a direction to reduce the distance between the two guides, wherein the pressing mechanism comprises a first pressing portion configured to apply a first urging force to urge the holder, wherein the adjuster comprises a second pressing portion configured to apply a second urging force to urge the holder, wherein the pressing load is determined b the first urging force and the second urging force, wherein the second pressing portion is configured to:

change the second urging force to increase the pressing load in response to the at least one of the two guides moving in the direction to enlarge the distance between the two guides; and change the second urging force to decrease the pressing load in response to the at least one of the two guides moving in the direction to reduce the distance between the two guides, wherein the holder is configured to swing around a second axis parallel to the first axis, the second axis being located upstream in the conveyance direction relative to a contact point between the separation roller and the separation pad;

wherein the separation pad is configured to become closer to the separation roller when the holder swings in a first swing direction, wherein the first pressing portion is disposed at a downstream side of the second axis in the conveyance direction, and configured to urge the holder in the first swing direction and generate the first urging force, and wherein the second pressing portion is configured to:

generate the second urging force by urging the holder in the first swing direction at an upstream side of the second axis in the conveyance direction;

increase the second urging force in response to the at least one of the two guides moving in the direction to enlarge the distance between the two guides; and decrease the second urging force to decrease the pressing load in response to the at least one of the two guides moving in the direction to reduce the distance between the two guides.

11. A sheet separator comprising:

a supporter configured to support one or more sheets;

two guides provided to the supporter, the two guides being disposed to face each other across a distance in a width direction of the one or more sheets supported by the supporter, at least one of the two guides being configured to move along the width direction to enlarge or reduce the distance between the two guides in the width direction, and position the one or more sheets supported by the supporter in the width direction;

a separation roller configured to rotate around a first axis parallel to the width direction, and convey the one or more sheets supported by the supporter in a conveyance direction;

a separation pad configured to separate sheets being conveyed by the separation roller, on a sheet-by-sheet basis in cooperation with the separation roller;

a holder configured to hold the separation pad in a manner capable of being closer to or farther from the separation roller;

a pressing mechanism configured to apply a pressing load to press the holder toward the separation roller; and an adjuster configured to increase the pressing load in response to the at least one of the two guides moving in a direction to enlarge the distance between the two guides, and decrease the pressing load in response to the at least one of the two guides moving in a direction to reduce the distance between the two guides, wherein the pressing mechanism comprises a first pressing portion configured to apply a first urging force to urge the holder, wherein the adjuster comprises a second pressing portion configured to apply a second urging force to urge the holder, wherein the pressing load is determined b the first urging force and the second urging force, wherein the second pressing portion is configured to:

change the second urging force to increase the pressing load in response to the at least one of the two guides moving in the direction to enlarge the distance between the two guides; and change the second urging force to decrease the pressing load in response to the at least one of the two guides moving in the direction to reduce the distance between the two guides, wherein the holder is configured to swing around a second axis parallel to the first axis, the second axis being located upstream in the conveyance direction relative to a contact point between the separation roller and the separation pad, wherein the separation pad is configured to become closer to the separation roller when the holder swings in a first swing direction, wherein the first pressing portion is disposed at a downstream side of the second axis in the conveyance direction, and configured to urge the holder in the first swing direction and generate the first urging force, and wherein the second pressing portion is configured to:

generate the second urging force by urging the holder in the first swing direction at a downstream side of the second axis in the conveyance direction;

increase the second urging force in response to the at least one of the two guides moving in the direction to enlarge the distance between the two guides; and decrease the second urging force to decrease the pressing load in response to the at least one of the two guides moving in the direction to reduce the distance between the two guides.

12. A sheet separator comprising:

a supporter configured to support one or more sheets;

two guides disposed to face each other across a distance in a width direction of the one or more sheets supported by the supporter, at least one of the two guides being configured to move along the width direction to enlarge or reduce the distance between the two guides in the width direction, and position the one or more sheets supported by the supporter in the width direction;

a separation roller configured to rotate and convey the one or more sheets supported by the supporter in a conveyance direction;

a separation pad configured to separate sheets being conveyed by the separation roller, on a sheet-by-sheet basis in cooperation with the separation roller; and a load adjusting mechanism comprising:

a holder configured to:

swing around a specific axis;

hold the separation pad by a first end portion of the holder in the conveyance direction; and apply a pressing load to press the separation pad against the separation roller;

a first pressing portion configured to be elastically deformed and apply a first urging force to the first end portion of the holder in the conveyance direction from a specific side of the holder, the specific side being opposite to a side of the holder facing the separation roller; and a second pressing portion disposed between the holder and the two guides, and the second pressing portion being configured to be elastically deformed and apply a second urging force to a second end portion of the holder in the conveyance direction from the specific side of the holder, the second end portion being opposite to the first end portion with respect to the specific axis, wherein the pressing load is determined by the first urging force and the second urging force, and wherein the load adjuster mechanism is configured to:

change the second urging force by displacing the second pressing portion in response to movement of the at least one of the two guides; and adjust the pressing load depending on a length in the width direction of the one or more sheets to be conveyed by the separation roller, by increasing the pressing load in response to the at least one of the two guides moving in a direction to enlarge the distance between the two guides, and decreasing the pressing load in response to the at least one of the two guides moving in a direction to reduce the distance between the two guides.

* * * * *